United States Patent [19]

Chu et al.

[11] Patent Number: 4,664,774

[45] Date of Patent: May 12, 1987

[54] LOW SOLIDS CONTENT, COAL TAR BASED IMPREGNATING PITCH

[75] Inventors: Arthur S. Chu, East Amherts, N.Y.; Edward F. Bart, Califon, N.J.; George R. Cook, Buffalo; David M. Horbachewski, West Seneca, both of N.Y.

[73] Assignee: Allied Corporation, Morris Township, Morris County, N.J.

[21] Appl. No.: 703,252

[22] Filed: Feb. 20, 1985

Related U.S. Application Data

[63] Continuation-in-part of Ser. No. 628,679, Jul. 6, 1984, abandoned.

[51] Int. Cl.[4] ..... C10G 9/00; C10G 11/00; C10C 1/04; C10C 3/00

[52] U.S. Cl. ..... 208/6; 208/22; 208/39; 208/42; 208/43; 252/500; 252/502; 423/447.1; 423/447.2; 423/447.6

[58] Field of Search ..... 208/6, 22; 252/500, 252/502

[56] References Cited

U.S. PATENT DOCUMENTS

| | | | |
|---|---|---|---|
| 2,074,689 | 3/1937 | Gambrill, Jr. | 208/6 |
| 2,135,424 | 11/1938 | Corkery | 208/6 |
| 2,200,914 | 5/1940 | Burk et al. | 196/74 |
| 2,985,577 | 5/1961 | Celler et al. | 208/6 |
| 3,173,851 | 3/1965 | King et al. | 208/42 |
| 3,238,116 | 3/1966 | Hamner et al. | 208/6 |
| 3,350,295 | 10/1967 | Hamner et al. | 208/4 |
| 3,928,169 | 12/1975 | Conroy | 208/22 |
| 4,096,056 | 6/1978 | Haywood et al. | 208/6 |
| 4,176,043 | 11/1979 | Van Eyk | 208/22 |
| 4,188,235 | 2/1980 | Espenscheidel | 208/22 |
| 4,474,617 | 10/1984 | Uemura et al. | 208/6 |

FOREIGN PATENT DOCUMENTS

| | | | |
|---|---|---|---|
| 1282655 | 4/1962 | Fed. Rep. of Germany | 208/6 |
| 1151572 | 10/1981 | Fed. Rep. of Germany | 208/22 |
| 1447861 | 5/1936 | United Kingdom | 208/6 |
| 569153 | 2/1944 | United Kingdom | 208/4 |
| 1135096 | 11/1968 | United Kingdom | 208/4 |
| 1379423 | 1/1975 | United Kingdom | 208/6 |
| 1601301 | 3/1985 | U.S.S.R. | 208/6 |

*Primary Examiner*—Andrew H. Metz
*Assistant Examiner*—Helane Myers
*Attorney, Agent, or Firm*—Jay P. Friedenson; Arthur J. Plantamura

[57] ABSTRACT

A novel coal tar based, low solids content, pitch is produced by oxidizing a selected coal tar distillation fraction with air to oxygen at elevated temperatures. This pitch is applicable to end use in which low solids content is desirable. Specifically it may be advantageously applied to the impregnation of carbon electrodes. The oxidized selected coal tar based low solids material described is characterized by high carbon yield and higher product density and has a higher in situ coking value and lower sulfur content which make it particularly beneficial when it is used as an impregnating pitch as compared to the currently commercially used petroleum based pitch.

10 Claims, 1 Drawing Figure

LOW SOLIDS CONTENT IMPREGNATING PITCH FROM COAL TAR OIL

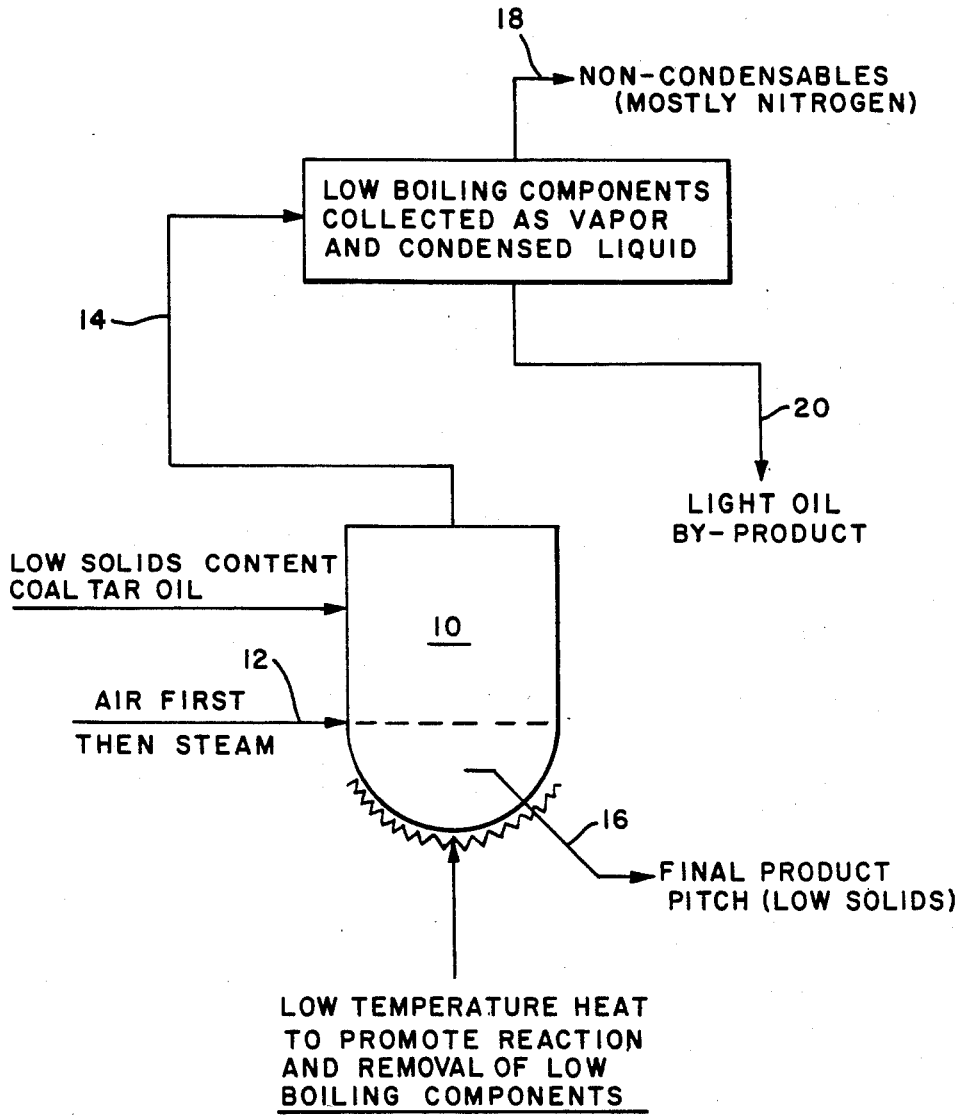
LOW SOLIDS CONTENT IMPREGNATING PITCH
FROM COAL TAR OIL

LOW SOLIDS CONTENT, COAL TAR BASED IMPREGNATING PITCH

The present application is a continuation-in-part of U.S. patent application Ser. No. 628,679 filed July 6, 1984, now abandoned.

The invention relates to an improved coal tar based, low solids content pitch which is produced by the oxidation at elevated temperature of a selected coal tar distillation cut using air or oxygen to yield a product whose end use benefits from the use of a low solids content.

BACKGROUND OF THE ART

The current industrial carbon electrodes are typically manufactured by blending petroleum coke particles (the filler) with molten coal tar pitch (the binder) and extruding the resultant mix to form the "green electrode". The green electrode is then baked at approximately 1300° C. These heat treating processes transform the green body from approximately 95% carbon content to greater than 99% carbon. During the heat treating process, some of the organics are destructively distilled or vaporized and others decomposed, resulting in carbon deposition in the electrode. As the vaporized materials exit the body of the electrode they channel through its walls producing a porous structure. The result of this inherent porosity is reduced density, and reduced current carrying capacity.

In the production of carbon electrodes, the carbon industry produces electrodes as large as 28 inches in diameter by 10 feet long for use in electric arc furnaces. These electrodes are used for example to carry large quantities of current in steel melting processes. The characteristics of a desirable carbon electrode are:

1. high density
2. high modulus of elasticity
3. high electrical conductivity
4. high flexural strength To reverse the undesirable effect of channeling, inherent porosity and reduced current carrying capacity the electrode is impregnated with an impregnating pitch which must have properties particularly suitable for this purpose.

Coal tar pitch has historically been used as the impregnant because of its relative high density and carbon content as compared to petroleum pitch. However, technological improvements in manufacturing carbon electrodes have led to reduced porosity and pore size of the green bocy. As a result, impregnating pitch of lower solid content must be used. Ordinary coal tar based pitch cannot meet this requirement. While the market is currently dominated by petroleum based pitch, this material also has certain definite drawbacks. Moreover, it is to be understood that solid content of a pitch is only one indicator of pitch quality; the ultimate measure of quality pertains to penetration rate (high rates are desired) and ultimate yield of coke after rebaking.

The solids content of a pitch is normally measured in weight percentage of the pitch and is determined by ASTM D2318-75 in terms of "quinoline insoluble" (QI).

At this point it is significant to note that the term "pitch" is applied to a wide range of compositions and there is a distinct difference between pitches used for various purposes. With particular reference to electrode production "pitch" may be used in at least three different ways.

1. Pitch can be coked to form "pitch coke" which is pulverized, sized and used as filler. Currently, most coke filler is produced from petroleum (as noted above). The manufacture of "pitch coke" from pitch produced by oxidizing coal tar at high temperatures is also known. However, it is to be noted, that pitch used as precursor of "pitch coke" has no "low solids" content requirement as does an impregnating pitch which is the material with which the present invention is concerned.

2. Pitch can be used as a binder or cement to hold the carbon electrode during forming and baking. This application requires a coal tar pitch with its inherently high quinoline insolubles (QI) content. The significance of quinoline insolubles in binder pitches is described, for example, in D. R. Ball, "The influence of the type of Quinoline Insolubles on the quality of coal tar binder pitch" (Carbon 16, page 205 [1978]). It is generally agreed, that the solids content of binder pitches is determined by the "QI" test. It should also be noted that previous use of high-temperature oxidation of carbonacious materials (petroleum, coal tar, and oils) to form pitches suitable for electrode production were directed toward the production of binder pitches, and pitches for pitch coke, not for impregnant pitches. These prior art pitches usually had a QI content of the order of 14 percent.

3. While reference to "impregnating pitches" for use in electrode production have been made, this application requires a pitch with distinctly "low solids" content. A discussion of the use of impregnating pitch and the physical properties of pitches used as both binders and impregnants may be found in Kirk-Othmer, Encyclopedia of Chemical Technology, Vol. 4, pg. 168, 181–183. The major difference between binder pitches and impregnating pitch can be seen from inspection of the "quinoline insoluble" line of Table 3, at page 168 of that reference.

TYPICAL COAL TAR BINDERS IN CARBON AND GRAPHITE MANUFACTURE

| | SOFT PITCH | MEDIUM PITCH | HARD PITCH | IMPREGNATING PITCH |
|---|---|---|---|---|
| QI % | 12 | 12 | 15 | 5 |

The QI of binders is significantly higher than the QI of impregnants. As shown, the QI content of a regular coal tar based impregnant is 5 wt%.

In recent years, the quality of electrode has improved and the criteria for specifying the impregnating pitch has become more stringent. Impregnating pitch containing 5 percent QI is no longer satisfactory. This is the reason petroleum based pitch displaced coal tar pitch in this application.

The current industrial standard is a petroleum based pitch which contains <0.5% QI. The coal tar pitch of the present invention also contains QI <0.5%. Previously no one has demonstrated the feasibility of producing high quality impregnating pitch based on coal tax oxidation.

An important characteristic of petroleum based impregnating pitch resides in the fact that it possesses a low solids content over regular coal tar pitch. This equates to greater productivity in that it takes less processing time to perform an impregnation. However, petroleum pitch suffers from the disadvantages of low density, high sulfur and low in-situ coking value. In-situ coking value rrefers to the actual yield of carbon in the electrode after baking as compared to the quantity of pitch originally "picked-up" during the impregnation process. For example, suppose an electrode is impregnated, and using "before" and "after" weights, it is determined that the electrode "picked-up" 100 pounds of impregnating pitch. This pitch is transformed to carbon by baking. During baking, low boilers are distilled from the pitch which results in a yield loss. The "before" and "after" weights for the baking process are used to determine the quantity of pitch remaining in the electrode as carbon. Thus, if the electrode after baking weighs 30 pounds more than "before" impregnation, then the in-situ coking value is 30/100=30%.

Typically, the specific gravity at 25° C. of a petroleum impregnating pitch is 1.24 and the specific gravity of a coal tar pitch is 1.30. This difference would equate to a 5% increase in "pick-up" for any impregnation step. It should also be noted that sulphur is an undesirable constituent of pitch because its presence results in an air pollution risk during baking and also produces "puffing" or an undesirable decrease in density phenomenon which can occur during graphitization. It is thus seen that a need exists for the provision of an improved pitch particularly characterized by low solids content, increased in-situ coking value and improved penetration and penetration rate.

SUMMARY OF THE INVENTION

An objective of the invention is to provide an improved coal tar product as a premium impregnating pitch in the manufacture of industrial carbon electrode. This improved impregnating pitch provides the following advantages over the petroleum based impregnating pitch:

(a) increased yields
(b) reduced sulfur content
(c) increased density

In addition, as shown by the comparison presented hereinafter, it offers high penetration rate (i.e., low solids content) as compared to other coal tar based pitches currently available.

The improved, coal tar based, impregnating pitch is produced by oxidizing a selected coal tar distillation fraction with air or oxygen at elevated temperatures. This pitch is applicable to end use in which low solids content is desirable. Specifically it may be advantageously applied to the impregnation of carbon electrodes. High carbon yield, higher product density and lower sulfur content are the primary benefits when it is used as an impregnating pitch as compared to the currently commercially used petroleum based pitch. The pitch is characterized by low solids content enhanced impregnation property, and high coke yields.

Heretofore, it has not been known that it was possible to produce an impregnating pitch from coal tar of a suitable practical quality. More specifically until the present discovery, the significance of selecting a "low solids" content feedstock and processing it at a specified temperature range was not recognized. In the invention, a processing temperature not greater than 750° F. (400° C.) is employed to produce a vastly superior coal tar based impregnant. Particularly advantageous properties of the pitch obtained, in accordance with the invention, include:

(a) sulphur content less than 0.5 wt.%
(b) a density at 77° F. greater than 1.28 grams per cc
(c) a Cleveland Open Cup flash point greater than 200° C.
(d) an in-situ coking value of 32 wt.%
(e) Rate of pick-up of impregnant by the electrode comparable to that of a petroleum pitch and exceeding that of other coal tar based pitches.

Additional advantages and attributes of the present invention will become apparent from the detailed description which follows.

DESCRIPTION OF THE PREFERRED EMBODIMENT

The improved impregnating pitch of the present invention comprises a product of oxidation of a high residue, low solids content, coal tar oil. The oil used as the precursor in making the desired pitch is obtained by isolating a middle cut during the distillation of crude coke oven tar. The quality of the precursor oil is critical. It is qualified by a filtration test and the solids content of the oil must be less than 0.05% as determined by ASTM D2318-76. The low solids heavy oil is oxidized by sparging with air at 300°–700° F. to yield an intermediate product substantially higher in average molecular weight than the precursor. The surface temperature of the reaction vessel is crucial. It is preferred to be kept below 700° F. and should not exceed 800° F., otherwise solids formation cannot be controlled. The intermediate product is then stripped with an inert gas (steam and nitrogen may be used) to remove undesirable low boiling constituents.

The endpoint of the oxidation period is determined by two criteria: (1) the yield of intermediate and (2) the softening point, as determined by ASTM D-3104-77.

As a guideline, the yield of intermediate product usually is 30–70% by weight. However, it is a function of the residue content of the feed stock determined by ASTM D246-73. The softening point of the intermediate should be approximately 30°–120° C. At this stage, stripping is commenced and continued until another 10% by weight of the original charge is removed. At this point the pitch is characterized according to the following criteria:

| | | | |
|---|---|---|---|
| 1. | Softening Point (°C.) | (ASTM D3104-77) | 100–150 |
| 2. | Coking Value-Conradson (wt. %) | (ASTM D2416-73) | 45 min. |
| 3. | Flash Point C.O.C. (°C.) | (ASTM D92-72) | 200 min. |

In accordance with the invention, the new coal tar based impregnating pitch is prepared by oxidation of a coal tar distillation cut.

To obtain a feedstock for production of the new improved coal tar based impregnating pitch, the crude tar is distilled to obtain a heavy creosote cut described as having a distillation residue at 355° C. of between 25 and 100 weight percent.

The two criteria used for choosing the feedstock are:

(1) the quinoline insoluble (QI) content must be less than 0.05 weight percent as determined by ASTM D-2318-76; and
(2) the distillation residue according to ASTM D246-73 is greater than about 25%, with about 60% preferred.

Other methods may also be used to suitably qualify heavy oils as satisfactory feedstocks, for example, as indicated in TABLE A below:

TABLE A

| | Oil Sample # | FILTRATION TIME 500 grams filter #4 Whatman filter paper on steamheated Buchner funnel with 20" Hg. Vac. @ 100° C. | QI ASTM D-2318-76 | TI ASTM D-4072-81 |
|---|---|---|---|---|
| Satis- | A | | .03 | |
| factory | B | 21 seconds | | .004 |
| Precursor | C | 36 seconds | | .05 |
| Unsatis- | D | | .45 | |
| factory | E | 19.3 minutes | | .47 |
| Precursor | F | 14.7 minutes | | .23 |

In preparing the oxidized coal tar component, as illustrated by reference to the figure of the drawing, the creosote starting material is heated in the vessel 10 at a temperature between about 300° F. (149° C.) and 750° F. preferably between about 600° F. (315° C.) and 725° F. (385° C.), while sparging copious amounts of air, as shown at 12, through the fluid and thereafter as it is being heated. The simultaneous heating and sparging effectively (a) strips off low boilers which are shown being removed at 14 and (b) oxidizes the residual tar shown as being withdrawn at 16 as it is being heated. When the desired temperature limit is attained, typically at about 725° F., (385° C.) although it will be apparent that steady state oxidation may be accomplished at lower temperatures probably down to 300° F. (149° C.) the air sparging is continued at that temperature and until the desired oxidized intermediate product is obtained. The non-condensable vapors are removed at 18 and light oil withdrawn at 20.

After obtaining the desired intermediate product the oxidation is terminated and stripping commenced with an inert gas, such as steam or nitrogen. In the stripping operation, steam is preferred because it is economical and is easily condensed out of the vapor stream. This reduces off-gas scrubbing equipment requirements. The inert gas stripping step, as a separate step, can be eliminated by using higher heat input during the oxidation step. In the stripping operation, undesirable low boiling constituents are removed from the pitch leaving the high molecular components. The endpoint of the stripping process is characterized by a softening point between 115° and 150° C., a Conradson coking value greater than 45% and a flashpoint greater than 392° F. (200° C.).

The invention will be further described by the following specific examples. It should be understood, however, that although these examples may describe in detail certain preferred operating conditions of the invention, they are given primarily for purposes of the illustration, and the invention in its broader aspects is not limited thereto. Parts expressed are parts by weight unless otherwise stated.

EXAMPLE 1

In this run, a total of 117,600 pounds (53390 Kg) of heavy coal tar oil were charged to a nominal 10,000 gallon (37800 liters) still in two increments. Using direct fire the contents were heated to 690° F. (365° C.) while sparging with an average 200 SCFM (5663 liter/min.) of air. 61% of the precursor oil was stripped off, either during oxidation or during the stripping cycle.

Seventy-four percent of the oxygen which was fed reacted with the coal tar oil.

Twenty thousand pounds (5952 Kg) of material were stripped off during the stripping period and steam was used as the stripping medium.

The finished impregnating pitch properties were:

| | |
|---|---|
| (A) Softening Point (ASTM D3104-77) | 123.8° C. |
| (B) Q.I. (wt. %) | .29 |
| (C) T.I. (wt. %) | 31.1 |
| (D) Ash (wt. %) | .009 |
| (E) Coke Conradson (wt. %) | 50.3 |
| (F) Sp. Gr. @ 77° F. | 1.298 |
| (G) Flash C.O.C. °F. | 450 |
| (H) C-9 Dist. % to | |
| 270° C. | 0.0 |
| 300° C. | 0.0 |
| 360° C. | 0.5 |

The actual properties of the heavy coal tar oil precursor although not recorded for this run were estimated as:

| | |
|---|---|
| Sp. g. @ 100° F. | 1.150 |
| Distillation, (wt. %) To | |
| 235° C. | 0.0 |
| 270° C. | 0.0 |
| 315° C. | 2.2 |
| 355° C. | 31.0 |
| % Residue at 355° C. | 68.9 |
| Xylene Insoluble Content (wt. %) | 0.02 |

EXAMPLE 2

2067 grams of heavy coal tar oil were charged to a ½ gallon reactor. The reactor was heated to 200° C. at which time the air flow rate was adjusted to 130 cc/min. (standard cubic centimeters per minute). The contents were continually oxidized as they were heated to 375° C. 51.7% of original charge was stripped off during oxidation period. The average air flow rate was approximately 450 scc/min (standard cubic centimeters per minute) and the softening point at the end of the oxidation period was 75.4° C. The pitch was then stripped with nitrogen until another 10% was stripped off based on the original charge. The final yield was 38%, the softening point was 126° C., the coking value was 55%.

A comparison of the coal tar pitch of the present invention with other pitch standards as shown in TABLE B below. The correlation between QI content, low solids content and penetration rate is demonstrated by this data. The rate of impregnant penetration of the carbon artifact is critical in juding an impregnant's quality. Assuming filtration of the pitch simulates the impregnating process, the data indicates a significant advantage for the coal tar pitch of the present invention. It is thus seen that the low solids composition of the invention which is a measure of the quantity of solids, as exhibited by filtration rates is significantly superior.

TABLE B

"LOW SOLIDS" CONTENT PITCH VS. PRIOR ART

| | Quinoline Insolubles By ASTM WT. % | Penetration Simulation(1) By Filtration Rate |
|---|---|---|
| Instant Invention Prepared During Example #1 | <.5 | 90 g/10 seconds |
| Typical Binder | 13.5 | 2 g/15 minutes |

TABLE B-continued

"LOW SOLIDS" CONTENT PITCH VS. PRIOR ART

| | Quinoline Insolubles By ASTM WT. % | Penetration Simulation[1] By Filtration Rate |
|---|---|---|
| Pitch[2] | | |
| Petroleum Pitch[3] | <.5 | 50 g/15 minutes |
| Low QI Coal Tar[4] Based pitch Prior Art | 7. | 5 g/15 minutes |

[1]Filtration of a designated pitch quantity through a 40 micron porous metal plate (¾" Diameter × ¼" thick) @ 225° C. @ 75 PSIG Differential Pressure.
[2]110° C. Binder Pitch available from Allied Corp., Detroit, MI.
[3]Ashland Oil A-240 Pitch, Available from Ashland Oil Co., Ashland, KY. Current industrial standard for impregnating pitch.
[4]15-V Pitch available from Allied Corp., Detroit, MI., previous industrial standard for impregnating pitch.

It will be apparent that various modifications may be made without departing from the scope and spirit of the invention. Accordingly, the several details disclosed herein as illustrative are not be be construed as placing limitations on the invention, except as such limitations may be recited in the appended claims.

We claim:

1. A method of obtaining a coal tar based impregnant pitch characterized by having a sulfur content of less than 0.5 weight percent and a quinoline insoluble, QI, content of less than about 0.5 percent and enhanced impregnation property comprising:

(a) selecting coal tar oil feedstock having:
  (1) a distillation residue @ 355° C. >30 weight percent; and
  (2) a QI <0.5 weight percent;
(b) heating the feedstock to a temperature of between about 150° C. and 390° C.; and
(c) oxidizing and stripping the feedstock until:
  (1) an ASTM D-3104-77 softening point between about 90° C. and 150° C.;
  (2) a coking value of at least 45 weight percent according to ASTM D-2416-73; and
  (3) a flashpoint of at least 200° C. according to ASTM D92-72 are obtained.

2. The method of claim 1 wherein the oxidation and stripping is continued until a softening point (c) (1) between 100° C. and 130° C. is obtained.

3. The method of claim 1 wherein the oxidation and stripping is continued until a coking value of at least 48 percent is reached.

4. The method of claim 1 wherein the feedstock has a distillation residue of between 50 percent and 70 percent at 355° C. as determined by ASTM D246-73.

5. The method of claim 3 wherein the feedstock has a distillation residue of between 50 percent and 70 percent at 355° C. as determined by ASTM D246-73.

6. The method of claim 1 wherein the stripping and oxidizing is conducted until the product attains a softening point between 110° C. and 130° C., a Conradson coking value greater than 45% and a flash point greater than 200° C.

7. The method of claim 1 wherein the stripping of the oxidized product as in step (c) is conducted until the product attains a softening point between 110° C. and 130° C., a Conradson coking value greater than 50% and a flash point greater than 240° C.

8. The method of claim 1 wherein the feedstock from step (b) is oxidized and subsequently stripped with steam.

9. A coal tar based pitch of low solids content, a sulfur content of less than 0.5 weight percent and enhanced impregnating characteristics comprising a coal tar oil middle cut having a distillation residue at 355° C. of between 25 and 100 weight percent which has been oxidized and stripped and has a softening point between about 90° C. and 150° C., a Conradson coking value greater than 45 percent and a flashpoint greater than 200° C., and a quinoline insoluble of not greater than 0.5 percent according to ASTM D2318-76.

10. A coal tar based pitch of low solids content and enhanced impregnating characteristics comprising a coal tar middle cut having a distillation residue at 335° C. of between 35 and 85 weight percent which has been oxidized and stripped and has a softening point between about 120° C. and 130° C., a Conradson coking value greater than 45 percent and a flashpoint greater than 235° C.

* * * * *

UNITED STATES PATENT AND TRADEMARK OFFICE

CERTIFICATE OF CORRECTION

PATENT NO. : 4,664,774

DATED : May 12, 1987

INVENTOR(S) : Arthur S. Chu, et al.

It is certified that error appears in the above-identified patent and that said Letters Patent is hereby corrected as shown below:

In Claim 10, Column 8, line 36, after "content", insert --, a sulfur content of less than 0.5 weight percent--.

Signed and Sealed this

Eighth Day of September, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,664,774

DATED : May 12, 1987

INVENTOR(S) : A.S. Chu et al.

It is certified that error appears in the above-identified patent and that said Letters Patent are hereby corrected as shown below:

Claim 1, column 7, line 32 " >30" should read -- >25--.

Claim 1, column 7, line 34 "< 0.5" should read --< 0.05--.

Signed and Sealed this

Twenty-eighth Day of June, 1988

*Attest:*

DONALD J. QUIGG

*Attesting Officer*

*Commissioner of Patents and Trademarks*